US008529154B2

(12) United States Patent
Alsaffar

(10) Patent No.: US 8,529,154 B2
(45) Date of Patent: Sep. 10, 2013

(54) OIL RECOVERY SYSTEM

(76) Inventor: Abdulreidha A. Alsaffar, Mubarak Al Kabir (KW)

( * ) Notice: Subject to any disclaimer, the term of this patent is extended or adjusted under 35 U.S.C. 154(b) by 0 days.

(21) Appl. No.: 13/584,377

(22) Filed: Aug. 13, 2012

(65) Prior Publication Data

US 2013/0081728 A1 Apr. 4, 2013

Related U.S. Application Data

(63) Continuation of application No. 13/252,074, filed on Oct. 3, 2011, now abandoned.

(51) Int. Cl.
*E02B 15/04* (2006.01)

(52) U.S. Cl.
USPC ..... 405/60; 405/210

(58) Field of Classification Search
USPC ..... 405/60, 210
See application file for complete search history.

(56) References Cited

U.S. PATENT DOCUMENTS

| | | | | | |
|---|---|---|---|---|---|
| 3,282,361 | A | * | 11/1966 | Mackie | 114/74 T |
| 3,756,294 | A | * | 9/1973 | Rainey | 405/65 |
| 4,506,623 | A | * | 3/1985 | Roper et al. | 405/210 |
| 4,790,936 | A | * | 12/1988 | Renfrow | 405/68 |
| 4,960,347 | A | * | 10/1990 | Strange | 405/60 |
| 5,243,925 | A | * | 9/1993 | Fortenberry | 114/74 T |
| 5,522,334 | A | * | 6/1996 | Chu | 114/74 R |
| 5,795,103 | A | * | 8/1998 | Gaerlan | 405/60 |

* cited by examiner

*Primary Examiner* — Frederick L Lagman
(74) *Attorney, Agent, or Firm* — Richard C. Litman

(57) ABSTRACT

The oil recovery system minimizes environmental contamination and oil leakage into the ocean in the event of a rupture of the hull of an oil tanker. The oil recovery system includes at least one buoyant reservoir for receiving recovered oil, which is deployed into the ocean upon detection of a breach or rupture in the hull of the oil tanker. At least one conduit is in fluid communication between at least one oil tank housed within the oil tanker and the at least one buoyant reservoir. Upon detection of an oil spill from the oil tanker, the at least one buoyant reservoir is released from the hull of the oil tanker into the water and oil from the at least one oil tank is routed to the at least one buoyant reservoir to minimize the size of the oil spill.

16 Claims, 4 Drawing Sheets

OIL RECOVERY SYSTEM

CROSS-REFERENCE TO RELATED APPLICATIONS

This is a continuation of my prior application Ser. No. 13/252,074, filed Oct. 3, 2011 now pending.

BACKGROUND OF THE INVENTION

1. Field of the Invention

The present invention relates generally to environmental safety, and particularly to an oil recovery system directed primarily for use aboard oil tanker ships and the like, but which may be adapted for use on the ground as well.

2. Description of the Related Art

The development of ever larger oil tanker ships has resulted in the potential for increasingly large oil spills and related accidents. Such potential environmental damage is of course not limited to the seas, but may occur on land as well. Oil spills and similar disasters may occur due to an accident involving a railroad train having one or more oil tanker cars, or perhaps an oil or fuel tanker truck on the highway. Oil spills are of course always a potential occurrence at any oil drilling or pumping site, an oil pipeline, or a refinery or distribution center.

As this potential for environmental damage has been realized, a number of different systems and devices have been developed for the containment of such spills. Devices such as oil containment booms for use on the water, oil and fuel absorbent materials, and other devices and systems are known. Such devices, however, are typically focused solely on the recovery of oil, which has already spilled into the water, rather than minimizing the size of the spill and preventing ever-increasing environmental damage.

Thus, an oil recovery system solving the aforementioned problems is desired.

SUMMARY OF THE INVENTION

The oil recovery system minimizes environmental contamination and oil leakage into the ocean in the event of a rupture of the hull of an oil tanker. The oil recovery system includes at least one buoyant reservoir for receiving recovered oil, which is deployed into the ocean upon detection of a breach or rupture in the hull of the oil tanker. Preferably, the at least one buoyant reservoir is suspended from a side of the hull in a manner similar to that conventionally used with lifeboats, so that the at least one buoyant reservoir automatically being lowered and deployed into the ocean in a similar manner.

At least one conduit is in fluid communication between at least one oil tank housed within the oil tanker and the at least one buoyant reservoir. Upon detection of an oil spill from the oil tanker, the at least one buoyant reservoir is released from the hull of the oil tanker into the water and oil from the at least one oil tank is routed to the at least one buoyant reservoir to minimize the size of the oil spill.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The oil recovery system 10 minimizes environmental contamination and oil leakage into the ocean in the event of a rupture of the hull of an oil tanker. It should be understood that the oil tanker 14 and oil spill OS of FIGS. 1 and 2 are shown for exemplary purposes only, and that the oil recovery system 10 may be utilized with oil tankers having a wide variety of configurations.

Figure 1:
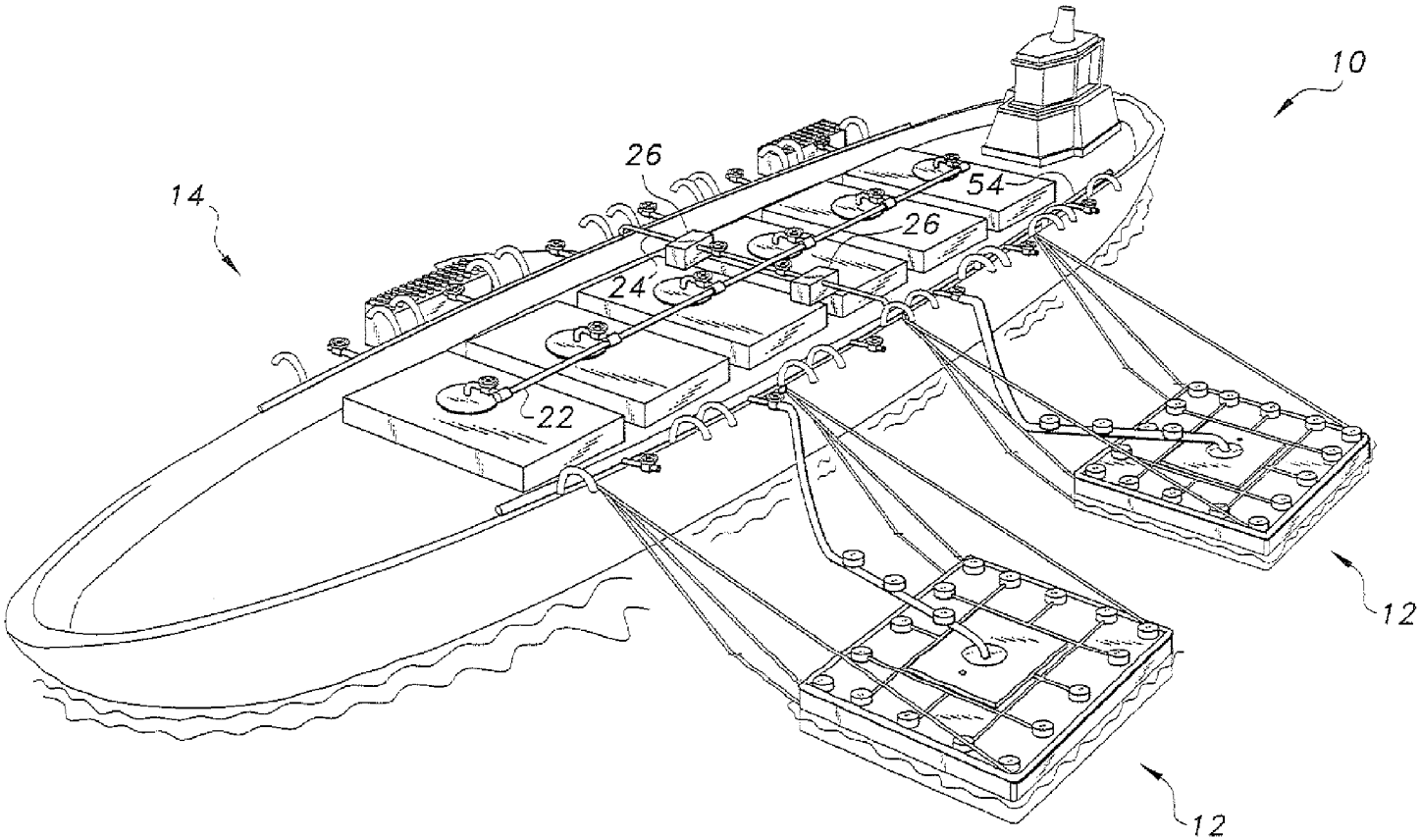
FIG. 1 is an environmental, perspective view of an oil recovery system according to the present invention.
Figure 2:
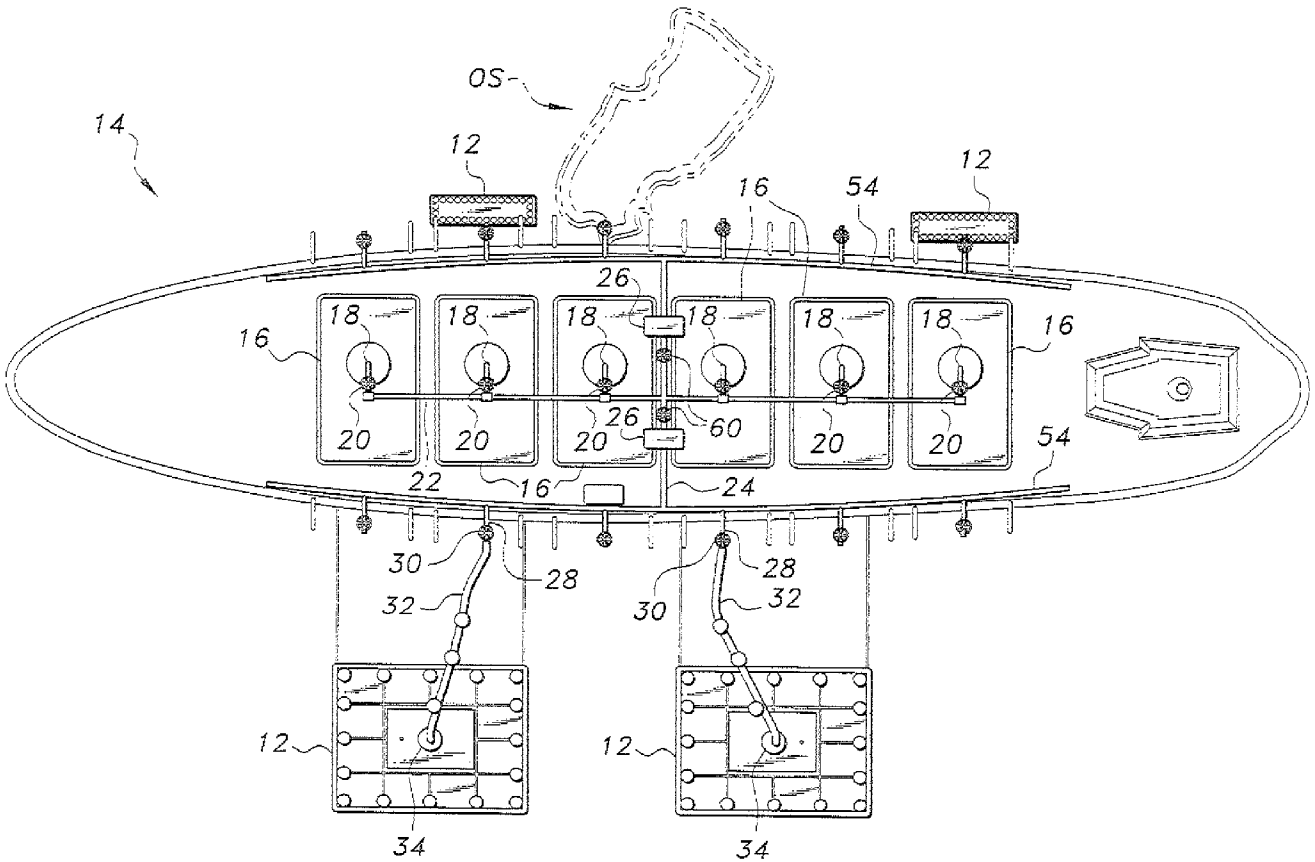
FIG. 2 is a top view of the oil recovery system of FIG. 1.

As best shown in FIGS. 1 and 2, the oil recovery system 10 includes at least one buoyant reservoir 12 for receiving recovered oil in the event of an oil spill, such as exemplary oil spill OS. It should be understood that any suitable number of buoyant reservoirs 12 may be used, depending upon the size, configuration and carrying capacity of the oil tanker 14. FIGS. 1 and 2 show only two such buoyant reservoirs 12 for illustrative purposes only.

Figure 3:
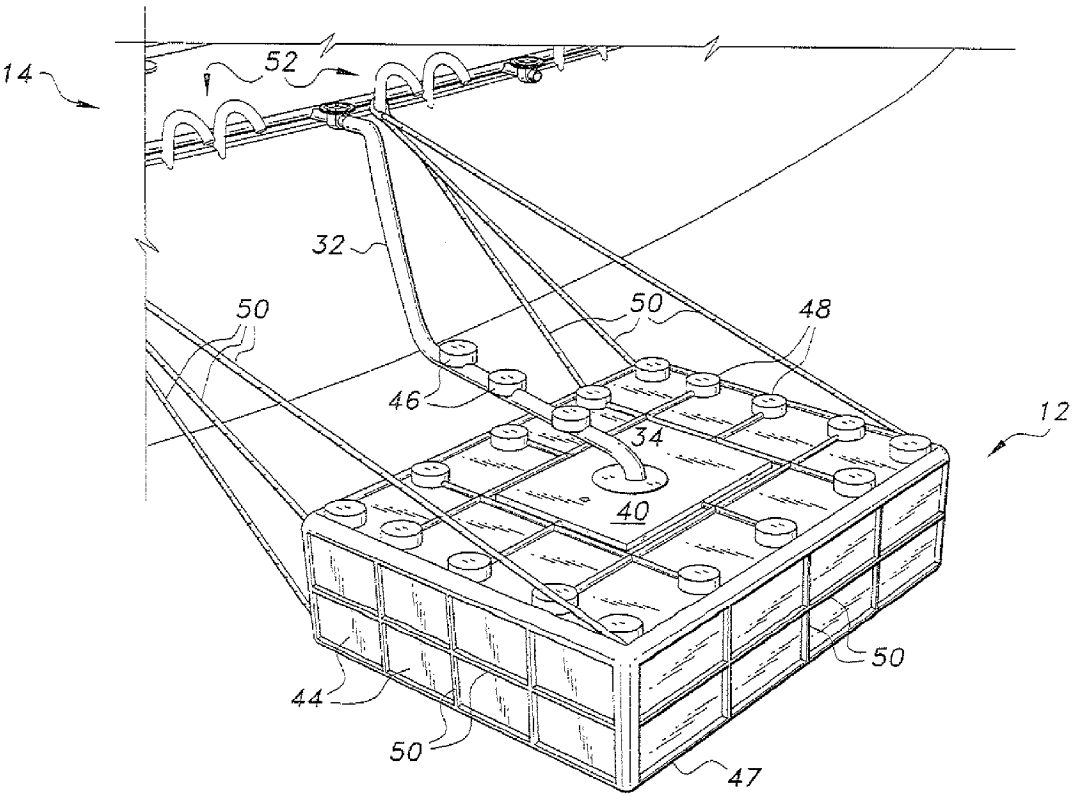
FIG. 3 is a partial perspective view of a buoyant reservoir of the oil recovery system of FIG. 1.
Figure 4:
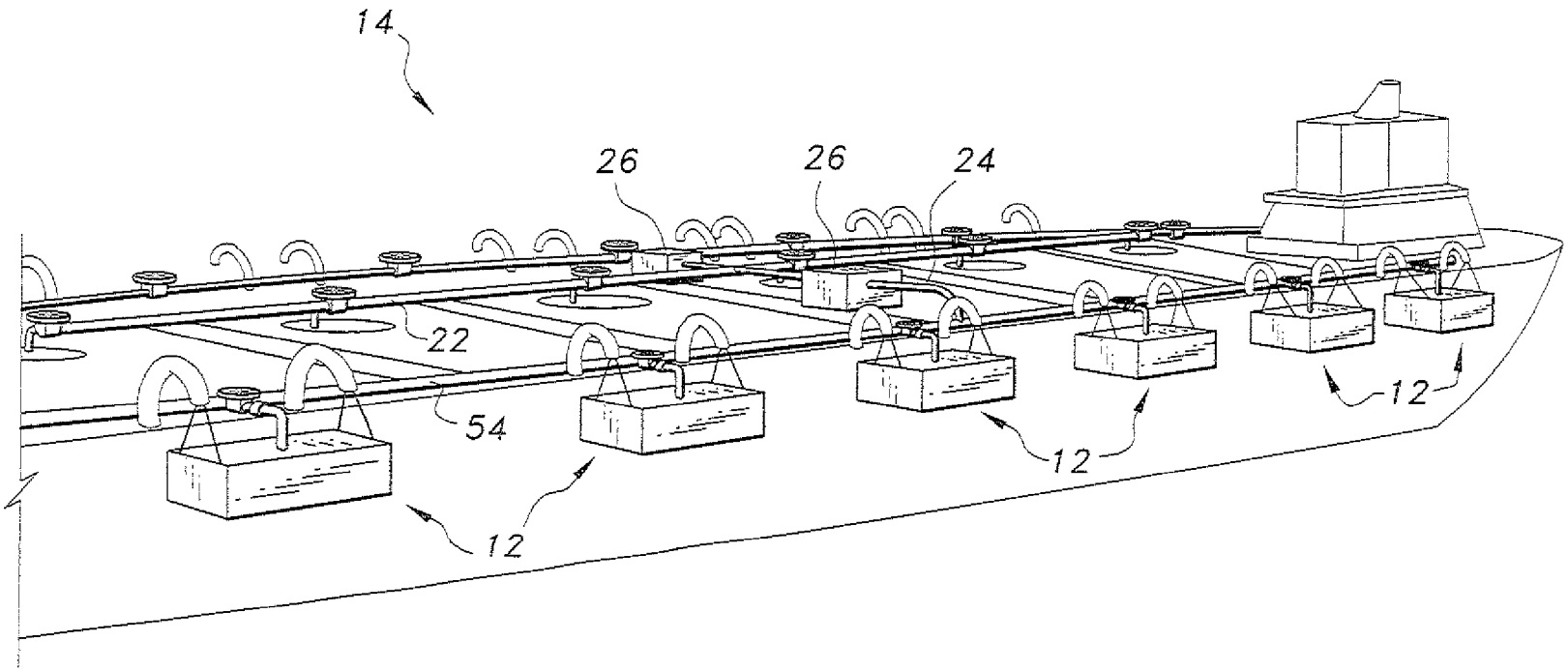
FIG. 4 is an environmental perspective view of a plurality of buoyant reservoirs for an oil recovery system according to the present invention, shown suspended from a hull of an oil tanker in a non-deployed state.

FIG. 4 illustrates six such buoyant reservoirs 12 suspended from only a portion of the hull of oil tanker 14, for example, the buoyant reservoirs 12 being in a non-deployed state. In the event of the detection of a hull breach or oil spill, the at least one buoyant reservoir 12 is deployed into the ocean. Preferably, the at least one buoyant reservoir 12 is suspended from a side of the hull of the ocean tanker 14 by releasable connectors 52 (shown in FIG. 3), in a manner similar to that conventionally used with lifeboats. The at least one buoyant reservoir 12 is either manually or automatically lowered and deployed into the ocean in a similar manner. Such suspension and deployment systems are known in the art. Examples of such systems for use with lifeboats are shown in U.S. Pat. Nos. 4,587,922; 4,841,901; 6,904,864; and 7,832,350, each of which is hereby incorporated by reference in its entirety.

As shown in FIG. 2, oil tankers typically have a plurality of individual oil tanks 16 housed therein. A longitudinal conduit 22 is in fluid communication with each oil tank 16 housed within the oil tanker 14, and also with the at least one buoyant reservoir 12. In the typical configuration shown in FIGS. 1 and 2, oil tanks 16 are aligned along a longitudinal axis, bisecting the tanker hull along a lengthwise direction. The longitudinal conduit 22 extends along this longitudinal axis, and communicates with each oil tank 16 through an oil outlet port 18 formed through each tank 16. Oil is released from each tank 16 to the longitudinal conduit 22 through tank valves 20 associated with each oil tank 16. The tank valves 20 may be any suitable type of valves for selectively releasing oil into the longitudinal conduit 22, and may be manually or automatically controlled. It should be understood that the arrangement of the longitudinal conduit 22 depends upon the configuration of the oil tanker 14 and the arrangement of the oil tanks 16 therein. It should be understood that oil is preferably not removed from each oil tank 16 upon detection of the oil spill OS, but only from the particular individual tank or tanks 16 that have been ruptured. The corresponding valves 20 of the ruptured tanks 16 will be opened upon hull breach and oil spill, but the valves 20 of non-ruptured tanks 16 will remain closed. Thus, each tank 16 must be fitted with its own valve 20, rather than having a single master valve for all tanks.

A lateral conduit 24 is in communication with the longitudinal conduit 22 for receiving and distributing the oil from oil tanks 16. It should be understood that the relative positioning of the lateral conduit 24, shown in FIGS. 1 and 2, corresponds centrally and substantially orthogonally with the arrangement of the longitudinal conduit 22, and may vary depending upon the configuration of the oil tanker 14 and the arrangement of the oil tanks 16 therein. The lateral conduit 24 feeds the oil removed from oil tanks 16 to hull conduits 54, which extend along the sides of the hull of oil tanker 14, as shown. As shown in FIG. 2, hull conduits 54 and buoyant reservoirs 12 are provided for each lateral side of the hull of the oil tanker 14, and the buoyant reservoirs 12 are deployed only on the side of the tanker 14 opposite the oil spill OS (so as not to interfere with cleanup of the oil spill OS).

The selective feeding of the oil from the oil tanks 16 to the hull conduit 54 opposite the oil spill OS is controlled by a pair of valves 60 positioned on laterally opposed sides of the lateral conduit 24, with each side feeding into its own oil pump 26, as shown. When the oil spill OS is detected on one side of the hull, the corresponding valve 60 on that side of the lateral conduit 24 remains closed, and the corresponding pump 26 remains deactivated, and the opposite valve 60 is opened with the corresponding pump 26 on the opposite side being activated. It should be understood that the valves 60 may be opened and closed automatically or manually, as is actuation of pumps 26. The pumps 26 may be any suitable type of pumps for pumping oil from oil tanks 16 to the hull conduits 54.

The oil is then pumped into the appropriate one of the hull conduits 54, and may then be released through hull outlets 28. As a further safety measure, each hull outlet 28 preferably has its own valve 30, which may be automatically or manually opened and closed. Upon opening of the valve 30, the oil flows through the hull outlet 28 into a flexible hose 32, extending between the hull outlet 28 and an input port 34 formed through the corresponding buoyant reservoir 12. The flexible hose 32 may be substantially S-shaped, as shown in FIG. 3, thus allowing the hose 32 to maintain an inclined angle during filling of the buoyant reservoir 12, even under the action of motion of the tanker 14 and ocean waves. The flexible hose 32 may have a thickness of six inches, for example, or any other suitable dimensions, depending upon the rate and quantity of oil being pumped from the particular tanks 16 of oil tanker 14.

FIG. 4 illustrates a plurality of buoyant reservoirs 12 in a non-deployed state. Upon detection of an oil spill OS from the oil tanker 14, the at least one buoyant reservoir 12 is released from the hull of the oil tanker 14 into the water by any suitable method, as described above, and oil from the at least one oil tank 16 is routed to the at least one buoyant reservoir 12 to minimize the size of the oil spill OS. As best shown in FIG. 3, each buoyant reservoir 12 has a plurality of buoyant floats 48 secured thereto, and is held to the hull of the oil tanker 14 by a plurality of mooring lines 50. First ends of the mooring lines 50 are secured to the hull, and free ends thereof are preferably wrapped around sidewalls 44 of the buoyant reservoir 12, as shown, providing not just secure mooring, but also adding to the structural stability of the sidewalls. In FIG. 3, the buoyant reservoir 12 is shown being shaped as a parallelepiped, although it should be understood that the buoyant reservoir 12 may have any desired relative dimensions or configuration. In addition to the primary floats 48 of the buoyant reservoir 12, the flexible hose 32 preferably has at least one secondary float 46 secured thereto, keeping the hose 32 out of the water and aiding in preventing the formation of constrictions therein. The mooring lines 50 may be any suitable type of lines, such as the typical cotton mooring lines 50 used to secure ships to docks.

The buoyant reservoirs 12 may be collapsible and expandable, thus decreasing their profiles when in the non-deployed state of FIG. 4. Expansion of the reservoirs 12 takes place in the water under the force of the pumped oil. In addition to the primary floats 48, the base 42 of each buoyant reservoir 12 is preferably formed from a resilient and buoyant material, such as rubber, foam rubber or the like. The upper end 40 of the buoyant reservoir 12 is similarly formed from a resilient and buoyant material. The overall thickness of each wall is preferably at least eight to ten mm, and may be formed as a dual wall, providing additional strength and security to prevent breaches in the reservoir walls.

It is to be understood that the present invention is not limited to the embodiments described above, but encompasses any and all embodiments within the scope of the following claims.

I claim:

1. An oil recovery system, comprising:

at least one buoyant reservoir;

means for releasably securing said at least one buoyant reservoir to a hull of an oil tanker;

at least one conduit in fluid communication between at least one oil tank housed within the oil tanker and said at least one buoyant reservoir;

said at least one conduit including a longitudinal conduit in fluid communication with each one of said at least one oil tank;

wherein a lateral conduit in communication with the longitudinal conduit;

at least one side hull conduit in communication with the lateral conduit and at least one hull outlet in communication with the at least one side hull conduit for feeding the oil from the plurality of oil tanks to said at least one buoyant reservoir; and means for selectively filling said at least one buoyant reservoir upon detection of an oil spill from the oil tanker, whereby when the oil spill is detected, said at least one buoyant reservoir is released from the hull of the oil tanker into the water and oil from the at least one oil tank is routed to the at least one buoyant reservoir to minimize the size of the oil spill;

wherein the at least one oil tank includes a plurality of oil tanks, and said at least one conduit in fluid communication between the at least one oil tank and the at least one buoyant reservoir comprises said longitudinal conduit in fluid communication with each of the plurality of oil tanks, the longitudinal conduit extending along a longitudinal axis defined by the plurality of oil tanks.

2. The oil recovery system as recited in claim 1, wherein the at least one conduit further comprises at least one flexible hose extending between the at least one hull outlet and an inlet port of the at least one buoyant reservoir.

3. The oil recovery system as recited in claim 2, wherein said means for selectively filling said at least one buoyant reservoir upon detection of the oil spill from the oil tanker comprises at least one pump in fluid communication with the lateral conduit.

4. The oil recovery system as recited in claim 3, wherein said means for selectively filling said at least one buoyant reservoir upon detection of an oil spill from the oil tanker further comprises at least one tank valve for selectively opening and closing an outlet port of the at least one oil tank in fluid communication with the longitudinal conduit.

5. The oil recovery system as recited in claim 4, wherein said means for selectively filling said at least one buoyant reservoir upon detection of an oil spill from the oil tanker further comprises at least one pump valve for selectively feeding the oil from the lateral conduit to the at least one pump.

6. The oil recovery system as recited in claim 5, wherein said means for selectively filling said at least one buoyant reservoir upon detection of an oil spill from the oil tanker further comprises at least one hull valve for selectively opening and closing the at least one hull outlet.

7. The oil recovery system as recited in claim 6, further comprising a plurality of primary buoyant floats secured to an upper surface of the at least one buoyant reservoir.

8. The oil recovery system as recited in claim 7, further comprising at least one secondary buoyant float secured to the at least one flexible hose.

9. The oil recovery system as recited in claim 8, further comprising a plurality of mooring lines extending between the hull of the oil tanker and the at least one buoyant reservoir.

10. The oil recovery system as recited in claim 9, wherein free ends of the plurality of mooring lines are at least partially wrapped around at least one sidewall of the at least one buoyant reservoir.

11. The oil recovery system as recited in claim 10, wherein the at least one buoyant reservoir is a parallelepiped.

12. An oil recovery system, comprising:

at least one buoyant reservoir;

means for releasably securing said at least one buoyant reservoir to a hull of an oil tanker;

a plurality of mooring lines extending between said at least one buoyant reservoir and the hull of the oil tanker;

at least one conduit in fluid communication between at least one oil tank housed within the oil tanker and said at least one buoyant reservoir;

said at least one conduit including a longitudinal conduit in fluid communication with each one of said at least one oil tank;

wherein the at least one conduit includes:

a lateral conduit in communication with the longitudinal conduit;

at least one side hull conduit in communication with the lateral conduit;

at least one hull outlet in communication with the at least one side hull conduit for feeding the oil from the plurality of oil tanks to said at least one buoyant reservoir; and at least one flexible hose extending between the at least one hull outlet and an inlet port of the at least one buoyant reservoir; and wherein said at least one oil tank comprises a plurality of oil tanks, and said at least one conduit in fluid communication between the at least one oil tank and the at least one buoyant reservoir comprises said longitudinal conduit in fluid communication with each of the plurality of oil tanks, the longitudinal conduit extending along a longitudinal axis defined by the plurality of oil tanks; and means for selectively filling said at least one buoyant reservoir upon detection of an oil spill from the oil tanker, whereby when the oil spill is detected, said at least one buoyant reservoir is released from the hull of the oil tanker into the water and oil from the at least one oil tank is routed to the at least one buoyant reservoir to minimize the size of the oil spill.

13. The oil recovery system as recited in claim 12, wherein said means for selectively filling said at least one buoyant reservoir upon detection of the oil spill from the oil tanker comprises at least one pump in fluid communication with the lateral conduit.

14. The oil recovery system as recited in claim 13, wherein said means for selectively filling said at least one buoyant reservoir upon detection of an oil spill from the oil tanker further comprises:

at least one tank valve for selectively opening and closing an outlet port of the at least one oil tank in fluid communication with the longitudinal conduit;

at least one pump valve for selectively feeding the oil from the lateral conduit to the at least one pump; and at least one hull valve for selectively opening and closing the at least one hull outlet.

15. The oil recovery system as recited in claim 12, further comprising a plurality of primary buoyant floats secured to an upper surface of the at least one buoyant reservoir.

16. The oil recovery system as recited in claim 12, wherein free ends of the plurality of mooring lines are at least partially wrapped around at least one sidewall of the at least one buoyant reservoir.

* * * * *